US008878107B2

(12) United States Patent
Zhao et al.

(10) Patent No.: US 8,878,107 B2
(45) Date of Patent: Nov. 4, 2014

(54) MULTI-LEVEL AND VERTICAL ASSEMBLING TYPE PTFE HEATER AND METHODS OF MANUFACTURE THEREOF

(75) Inventors: Yonggao Zhao, Zhejian (CN); Wei Zhao, Zhejian (CN); Guolong Chen, Zhejian (CN)

(73) Assignee: Yonggao Zhao, Wenzhou, Zhejian (CN)

( * ) Notice: Subject to any disclaimer, the term of this patent is extended or adjusted under 35 U.S.C. 154(b) by 415 days.

(21) Appl. No.: 12/782,025

(22) Filed: May 18, 2010

(65) Prior Publication Data

US 2011/0155719 A1 Jun. 30, 2011

(30) Foreign Application Priority Data

Dec. 25, 2009 (CN) ..... 2009 1 0155832

(51) Int. Cl.
*H05B 3/06* (2006.01)
*F27D 11/00* (2006.01)

(52) U.S. Cl.
USPC ..... 219/523; 219/437; 219/476; 219/478; 219/483; 219/532; 219/538; 219/539; 219/542

(58) Field of Classification Search
USPC ..... 219/390, 536, 538, 539, 542, 546–548, 219/437, 476, 478, 483, 523
See application file for complete search history.

(56) References Cited

U.S. PATENT DOCUMENTS

| | | | | |
|---|---|---|---|---|
| 4,243,872 | A * | 1/1981 | Best | 219/532 |
| 4,849,608 | A * | 7/1989 | Muraoka et al. | 219/390 |
| 5,497,394 | A * | 3/1996 | Jhawar et al. | 373/130 |
| 6,298,784 | B1 * | 10/2001 | Knowlton et al. | 102/275.3 |
| 2003/0150850 | A1 * | 8/2003 | Michelmann | 219/545 |

FOREIGN PATENT DOCUMENTS

CN 201119002 A1 9/2008

* cited by examiner

*Primary Examiner* — Jesse Y Miyoshi
(74) *Attorney, Agent, or Firm* — Global IP Services; Tianhua Gu

(57) ABSTRACT

The present invention relates to a multi-level and vertical assembling type PTFE heater and the methods of manufacture thereof. Said heater includes a vertical frame assembled by multi-poles and upper and lower retaining plates. Several levels of PTFE sleeves and electrical heating belts are alternatively disposed on the multi-poles. The number of the poles is determined in accordance with the size and capacity of a heater desired and the power and levels of PTFE electrical heating belts with heating needs. Multiple levels of PTFE electrical heating belts are formed in an assembling way, by which heaters with varied powers are easily produced and with the elements replaceable, will not be wholly wasted in event of an element damaged, thus the heater service life prolonged. Said heater has a better heating result than the one with only a single level of heating structure.

3 Claims, 2 Drawing Sheets

MULTI-LEVEL AND VERTICAL ASSEMBLING TYPE PTFE HEATER AND METHODS OF MANUFACTURE THEREOF

CROSS REFERENCE TO RELATED PATENT APPLICATION

The present application claims the priority of Chinese patent application No. 200910155832.X filed on Dec. 25, 2009, which application is incorporated herein by reference.

FIELD OF THE INVENTION

The present invention relates to a PTFE heater, particularly to a multi-level and vertical assembling type PTFE heater and the methods of manufacture thereof.

BACKGROUND OF THE INVENTION

In the production of chemical products, reaction kettles are widely used, in which the reactants are heated by the heating agents put in the jackets on the outside of the kettles or the coil tubes inside the apparatuses. The heating agents are usually high temperature heat-conducting oil or high temperature steam. The heating method is disadvantageous not only in a slow heating speed and low heat efficiency but also unavailable high temperature, which hinders the starting of many new projects for high-efficient reaction kettles for high temperature and highly corrosive reactants. China Patent No. 200720114988.X for "PTFE-insulated heating product" provides a thin-wall cylindrical PTFE heater of integrated structure, which with heating elements imbedded inside its PTFE layer, is placed in a reaction kettle for direct media heating. The product is innovative in eliminating quite a few drawbacks brought by heating by means of jackets or coil tubes. But the patent is still defective in ① inconvenient manufacture, for the product, as an integrated structure, will have to be wholly abandoned (for PTFE cannot be repaired) if a minute damage occurs to the large area of its PTFE layer in the process of manufacture or operation; ② incapacity of being made with a high power, for the product, as a single layer cylindrical structure, has a limited area and cannot contain too many electrical elements, thus hindering its wide application.

SUMMARY OF THE INVENTION

The technical solution of the present invention is to provide a multi-level and vertical assembling PTFE heater to eliminate the defects of existing thin-wall cylindrical PTFE heater of integrated structure.

A multi-level and vertical assembling type PTFE heater comprising: a 3D frame (10) assembled by a plurality of multi-poles (1) and an upper and a lower retaining plates (6, 3); a plurality of PTFE sleeves (4) and a plurality of PTFE-insulated electrical heating belt plates (7) being on said plurality of multi-poles (1) in an alternate order of one heating belt plate and one level of plurality of PTFE sleeves along the multi-pole.

The said PTFE heater of the present invention includes a 3D frame composed of assembled multi-poles, and upper and lower retaining plates. On the said poles, PTFE sleeves are provided around their circumference and lengthy PTFE-insulated electrical heating belts are supported at varied levels and positioned between each pair of the said sleeves. The number of the poles is decided in accordance with the size and heating intensity of the PTFE heater, and depending on equipment to be heated, the power and number of levels of the PTFE-insulated electrical heating belts can be varied.

In order to improve on the structural strength of the said whole PTFE heater, the technical solution of the present invention further includes the following arrangements. The said multi-poles are arranged with an equal space in two rows (inner and outer), one pole in a row corresponding to the other in the other row. The said PTFE-insulated electrical heating belts include several holders, at the both ends of which are provided holes for movably fitting with inner and outer poles, and in the middle part of each of which are provided a plurality of slots for the said electrical heating belts to be plugged in. The PTFE-insulated electrical heating belt at one level is formed by the heating belt plugged in the slots of the holders, and each level of the heating belt is positioned between inner and outer poles (corresponding to each other) of the 3D frame by the inner and outer holes of the holders for the electrical heating belt.

The benefits of the present invention are that ① owing to the adopted structure formed by assembling multi-level PTFE-insulated electrical belts, the said PTFE heater with different power can be easily produced on users' request, its application thus enlarged; ② any damaged electrical heating elements, which are replaceable, of the said PTFE heater will not lead to the wasting of the said whole heater, the said heater service life therefore prolonged; ③ with a multi-level structure adopted, the said PTFE heater can obtain better heating results in terms of heating media than the integral heater with only a single level.

Hereinafter, the present invention will be further illustrated with reference to the accompanying drawings and an embodiment.

DETAILED DESCRIPTION OF THE INVENTION

Figure 1:
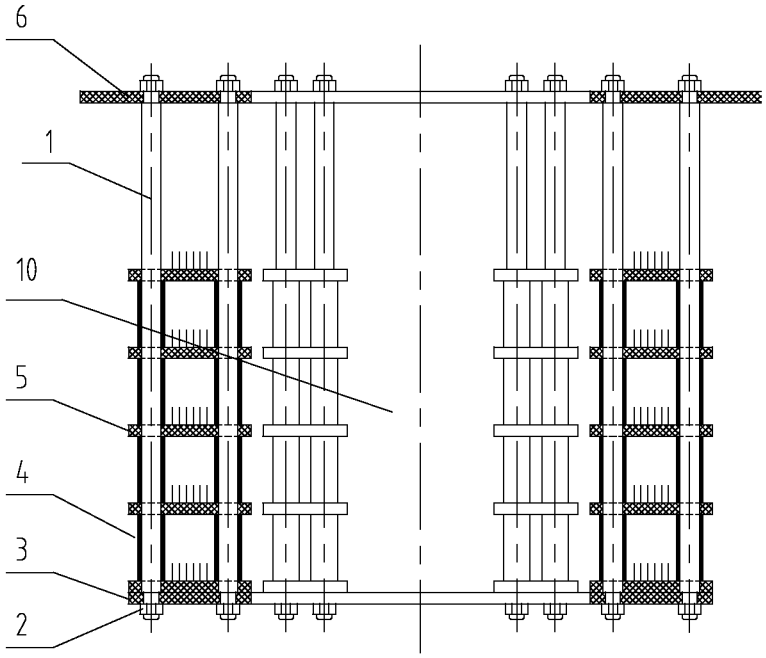
FIG. 1. is a schematic view of the whole structure of an exemplary embodiment of this invention.
Figure 2:
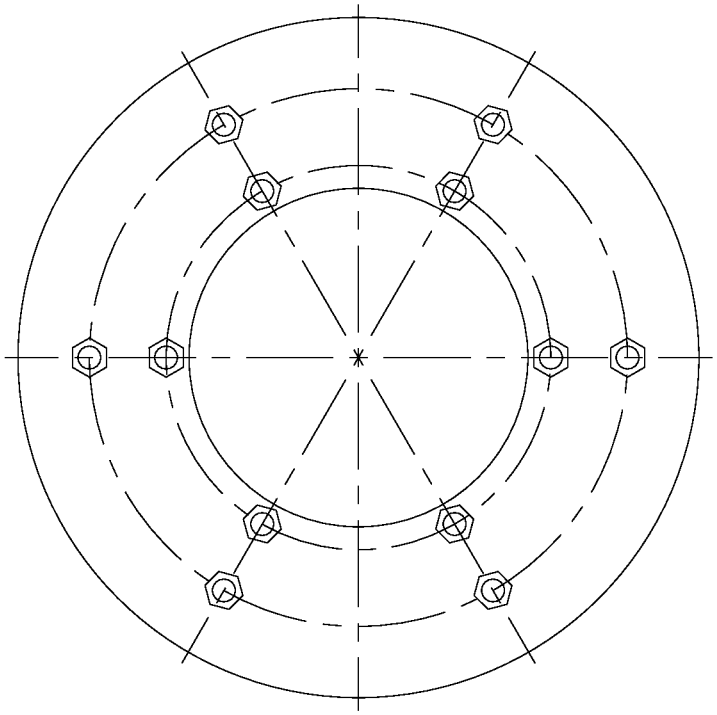
FIG. 2. is a top view of the FIG. 1.
Figure 3:
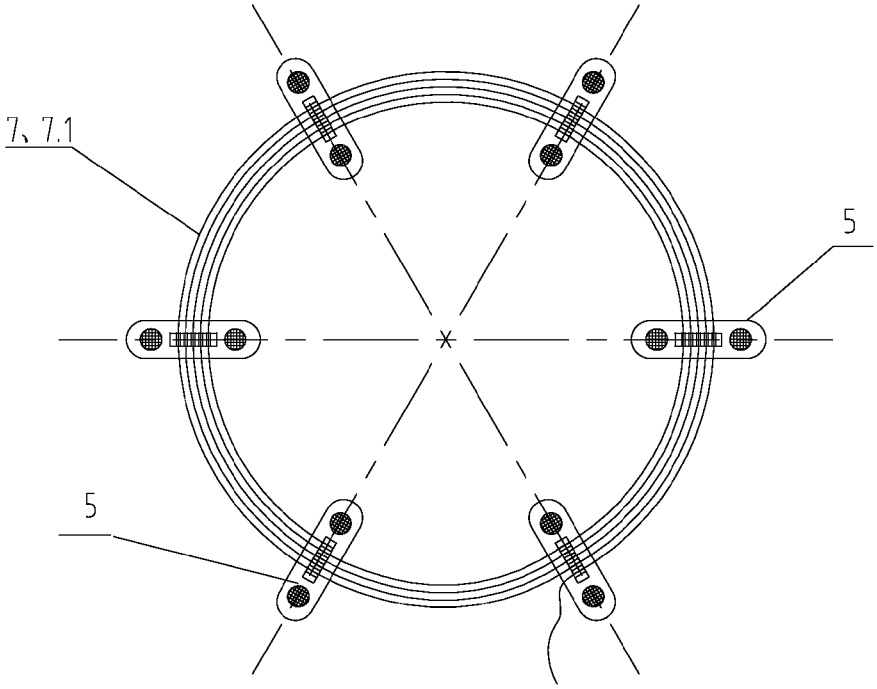
FIG. 3. is a schematic view of the structure of the PTFE-insulated electrical heating belts installed.
Figure 4:
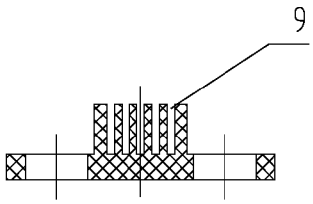
FIG. 4. is a schematic view of the structure of the holders for the PTFE-insulated electrical heating belts.
Figure 5:
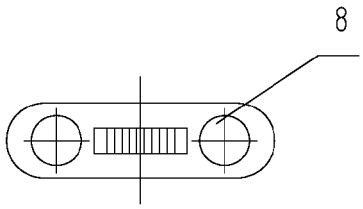
FIG. 5. is a top view of the FIG. 4.

In the exemplary embodiment shown in FIGS. 1, 2, 3, 4 and 5, the said multi-level and vertical assembling type PTFE heater contains 6 end-threaded poles 1 arranged in the inner and outer rows respectively, upper retaining plate 6 and lower retaining plate 3, 3D frame 10 having a structure of two inner and outer rows and consisting of 6 inner poles, 6 outer poles, upper retaining plate 6 and lower retaining plate 3 assembled by nuts 2, and PTFE sleeves 4 disposed on the said inner and outer poles and at several levels. The PTFE-insulated electrical heating belts 7, for the purpose of fixing the belt 7, includes six holders 5, at the both ends of which holes 8 are provided for movably fitting with inner and outer poles and in the middle part of which are arranged a plurality of slots 9 for placing the said electrical heating belt 7.1. The said belt 7.1, plugged in the slots of the belt holders in form of a ring, constitutes the PTFE-insulated electrical heating belt 7 at one level and the belt at each level is positioned between inner and outer poles 1 (corresponding to each other) of the 3D frame 10 by the two inner and outer holes 8 of each of the belt holders 5.

In order to facilitate the said heater to be placed in an apparatus (such as a reaction kettle) to be heated, the heater is provided with a bracket (not shown in the figures), on which the said retaining plate 3 is supported and the size of which is decided in accordance with the space for installing the said heater in an apparatus to be heated.

Hereunder, an exemplary embodiment will be described to illustrate the production of the said multi-level and vertical assembling type PTFE heater and its application in an apparatus (such as a reaction kettle).

1. 3D frame formation 1.1 Insert end-threaded poles (12 pieces in this exemplary embodiment) into the screw holes in the inner and outer rings of the lower retaining plate 3 and fasten the poles with nuts 2 from under the plate 3;

1.2 Slide the holes 8 at the both ends of the belt holders 5 (6 pieces in this exemplary embodiment) along the poles 1 in two rows and corresponding to each other.

1.3 Push the belt holders 5 downwards onto the lower retaining plate to form the base of the first (the lowest) level of the said heating belt.

2. PTFE-insulated electrical heating belt formation

Embed electrical heating elements (electrical heating wires or tapes) within a PTFE layer to form a thin PTFE-insulated electrical heating belt 7.1 (with a thickness of about 3 mm and width of 30 mm in this exemplary embodiment) with varied power.

3. Assembling 3.1 Plug and fix the PTFE-insulated electrical heating belt 7.1 with a specified length in the slots 9 of the belt holders 5 at the same level one after the other in a ring, and from the most inner slots to the outside, that is, in order of the first ring of slots, the second slots, the third and so forth till the plugging of the belts is finished so as to form one level of the thin PTFE-insulated electrical heating belts 7 (for instance, with power of 10 kw).

3.2 With the first level of the heating belt installed, begin to plug and install the second level. First slide PTFE sleeves 4 with a certain height along every pole 1, leaving spacing between the first level of the said heating belt and the second (for media circulation). After finishing the PTFE sleeve installation, install the belt holders 5 for the second level.

3.3. The heating belt installation for the second and each of the remaining levels is made in the same way as that for the first till the installation for desired levels (depending on power needed) of the heating belts is accomplished. Assuming one level of the said heating belt has a power of 10 kw, two levels of the belts will have 20 kw . . . and ten levels will have 100 kw.

3.4. After finishing the installation of the desired levels, assemble the upper retaining plate 6 on each of the poles 1 and fasten the poles with nuts 2. With an outer diameter same as or slightly smaller than the inner diameter of an apparatus (the main body of a reaction kettle) to be heated, the upper retaining plate 6 is to be placed inside a reaction kettle body with its OD contacting the inside wall of the body. Several holes with their number identical to that of the said heating belts are defined along the periphery of the upper retaining plate. The end of each heating belt goes through the holes to and out of the upper flange sealing surface of the reaction kettle body for connection with a power source.

3.5 The lower retaining plate 3 of the said PTFE heater is in contact with the inner surface of the lower end plate of the reaction kettle. A PTFE-insulated support is disposed under the lower retaining plate 3 for supporting the said PTFE heater.

It is understandable that the above exemplary embodiment is only one of the possible methods for implementing the present invention and the above-mentioned parameters are only part of the above exemplary embodiment. The number of members of the said PTFE heater, such as poles, sleeves, belt holders, electrical heating belts, etc., and that of the levels of the heating belts can be set as desired. The production method of the said PTFE heater is also not limited to the above description.

The foregoing descriptions of the embodiment and its accompanying drawings of the invention are intended to illustrate and not to limit this invention. Various changes and modifications may be made to the embodiment without departing from the spirit of the invention. Therefore, the scope of the invention is to be limited only by the appended

What is claimed is:

1. A multi-level and vertical assembling type PTFE heater comprising:

a 3D frame (10) assembled by a plurality of multi-poles (1) and an upper and a lower retaining plates (6, 3), each said multi-pole is composed of inner and outer poles and the plurality of multi-poles are vertically oriented and arranged in a circular shape such that the inner pole is provided between the center of the circular shape and the outer pole;

a plurality of PTFE-insulated electrical heating belt plates (7), each composed of a plurality of belt holders and a PTFE-insulated electrical heating belt (7.1) which comprises electrical heating elements embedded within a PTFE layer, the belt holder (5) provided with two holes (8) at both ends for movably fitting with the inner and outer poles (1) and has a plurality of vertical slots (9) between the two holes, each PTFE-insulated electrical heating belt plate has said PTFE-insulated electrical heating belt (7.1) which passes between the outer and inner poles of each multi pole forming a spiral by being vertically inserted into the vertical slots of the belt holders starting from the inner most vertical slots of each belt holder and passing through the remaining vertical slots until each vertical slot is occupied by said PTFE-insulated electrical heating belt;

a plurality of PTFE sleeves (4); and along the length of each multi-pole, PTFE sleeves (4) on each of the inner and outer poles separates the belt holders of adjacent PTFE-insulated electrical heating belt plates that are affixed along the same multi-pole, thereby the plurality of PTFE-insulated heating belts (7.1) are separately fixed in the vertical direction along the inner and outer poles;

thereby, the PTFE-insulated electrical heating belts can be fixed together in high density to heat corrosion liquid directly with high intensity.

2. A multi-level and vertical assembling type PTFE heater of claim 1 wherein said heater has a support, on which said lower retaining plate is disposed.

3. The multi-level and vertical assembling type PTFE heater of claim 1 wherein the upper and lower retaining plates (6, 3) are shaped as a ring, an outer diameter of the ring is same as or slightly smaller than the inner diameter of a reaction kettle for the heater.

* * * * *